US005247757A

United States Patent [19]

Deeb

[11] Patent Number: 5,247,757

[45] Date of Patent: Sep. 28, 1993

[54] PART FOR A GUN

[76] Inventor: Tom Deeb, 1015 Spring Mill, Mansfield, Ohio 44906

[21] Appl. No.: 838,354

[22] Filed: Feb. 19, 1992

[51] Int. Cl.[5] ..... F41C 17/04

[52] U.S. Cl. ..... 42/70.08

[58] Field of Search ..... 42/70.08, 70.01, 70.04, 42/70.05, 70.06

[56] References Cited

U.S. PATENT DOCUMENTS

| | | | |
|---|---|---|---|
| 3,724,113 | 4/1973 | Ludwig | 40/70.08 |
| 4,011,678 | 3/1977 | Brodbeck et al. | 40/70.08 |
| 4,021,955 | 5/1977 | Curtis | 42/70.08 |
| 4,090,316 | 5/1978 | Volkmar | 42/70.08 |
| 4,352,317 | 10/1982 | Wilhelm | 42/70.08 |
| 4,454,673 | 6/1984 | Meidel | 42/70.08 |
| 4,555,861 | 12/1985 | Khoury | 42/70.08 |
| 4,744,166 | 5/1988 | Mattarelli | 42/70.08 |
| 4,866,869 | 9/1989 | Mainland | 42/70.08 |
| 5,036,612 | 8/1991 | Jennings | 42/70.08 |

*Primary Examiner*—David H. Brown
*Attorney, Agent, or Firm*—Jerry Semer

[57] ABSTRACT

This invention is basically a small plate that is spring loaded that fits under the sear pin of a hammerless firearm. Under normal conditions when the firearm is fired the sear pin will drop into a notch in the plate. The notch is of sufficient depths that the sear pin can fall a sufficient depth and release the spring loaded firing pin and thus fire the firearm. However, if the gun is dropped, upon impact with the ground this plate moves backward and as the sear pin drops, the sear pin makes contact with the ridge of the plate and is unable to fall into the notch and thus is unable to release the firing pin.

4 Claims, 1 Drawing Sheet

PART FOR A GUN

FIELD OF THE INVENTION

This invention concern a safety device for a hammerless firearm and more particularly a safety device that ensure that the firearm will not fire upon impact when dropped upon its rearend.

BACKGROUND OF THE INVENTION

One of the biggest hazard of a firearm is that it may fire upon impact when dropped upon it rearend. In the industry there are dozens of lawsuits each year because the handgun was dropped and upon impact fired, injuring or even killing an individual. Thus, a device that prevents a handgun from firing when dropped is clearly sought after by the industry. There has been a large number of patents granted in this area to prevent handgun with hammers from firing when dropped. Some of these include Khoury U.S. Pat. No. 4,555,861, Wilhelm U.S. Pat. No. 4,352,317, Volkmar U.S. Pat. No. 4,090,316 and Meidel U.S. Pat. No. 4,454,637. However, all these patents apply to a handgun with a hammer. The inventor's system apply to a firearm without a hammer. The inventor's system also works no matter whether the safety is on or off. It is an object of the present invention to create a safety device for a firearm without a hammer that prevents accidental discharge when the firearm is dropped and the rear portion of the firearm make impact with a surface. A further object of this invention is to provide this safety mechanism that achieve these objects while being rugged has a relative low manufacture cost.

The inventor has found that when a hammerless handgun is dropped and makes impact with the ground with its barrel pointed upward the inertia of the trigger actually causes the trigger to engage. The invention due to its inertia will move at a similar rate to the trigger and counteract the actions of the trigger upon impact. The feature that creates this is a small spring loaded plate that has a notch in it. The advantages of this invention is that this plate can be easily and inexpensive manufacture by a simple stamping method and is inexpensive to assemble within the gun. Further advantage of this invention is that no matter whether the safety is on or off the hammerless firearm will not fire upon impact when dropped upon its rearend.

SUMMARY OF THE INVENTION

This invention is basically a small plate that is spring loaded that fits under the sear pin of a hammerless firearm. Under normal conditions when the firearm is fired the sear pin will drop into a notch in the plate. The notch is of sufficient depths that the sear pin can fall a sufficient depth and release the spring loaded firing pin and thus fire the firearm. However, if the gun is dropped, upon impact with the ground this plate moves backward and as the sear pin drops, the sear pin makes contact with the ridge of the plate and is unable to fall into the notch and thus is unable to release the firing pin.

DETAILED DESCRIPTION OF THE PREFERRED EMBODIMENT

Figure 2:
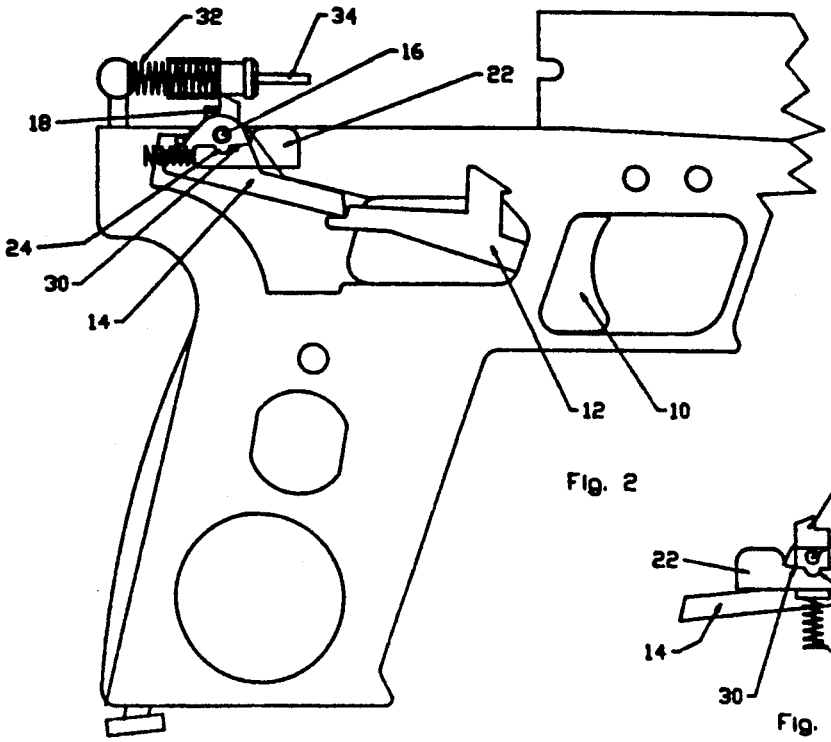
FIG. 2 is a view of one side of the handgun.

FIG. 2 is a side view of a handgun with the invention in place. When a handgun is fired under normal conditions the trigger 10 is pulled towards the rear of the gun. The trigger then causes the trigger bar 12 to move which further causes the release lever 14 to pivot which allows the sear pin 18 to drop. The sear pin 18 is attached to the release lever 14 by a cylindrical rod 16. When the sear pin 18 drops it releases spring 32 which propels the firing pin 34 and the gun fires.

Figure 3:
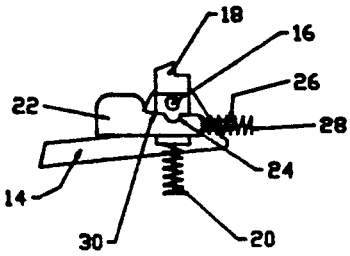
FIG. 3 is the view of the invention showing the sear pin above it.

The invention can be seen more closely in FIG. 3. In FIG. 3 in the background one can see the release level 14 and the sear pin 18 with cylindrical rod 16. The sear pin 18 is held in place by a spring 20. The invention comprises of a plate 22 with a notch 24, a leg 26 and a ridge 30. Said leg 26 fits within a spring 28 which holds the plate in position in the handgun. Under normal firing conditions the cylindrical rod extending from the sear pin 18 falls within the notch 24 of the plate 22. The notch 24 allows the sear pin 18 to fall a sufficient distant to release the firing pin 32.

However, when the gun is dropped and makes impact on a surface on its rearend the plate 22 due to it inertia travels rewardly towards the rear of the handgun. When this occurs the cylindrical rod 16 extending from the sear pin 18 can no longer fall within notch 24 and falls upon ridge 30. When the sear pin 18 falls upon ridge 30 it can not fall far enough to release the spring 32 which propels the firing pin 34. Thus, the pistol will not fire.

The inventor has found that found when a hammerless firearm is dropped and land on it rearend, the trigger 10 usually has enough inertia to cause the firearm to fire. Thus a solution to the problems is to have a plate, whose interia carries it rearward, fall under the sear pin 18 so that the sear pin 18 can not fall a sufficient distance to release the firing pin 34.

Figure 1:
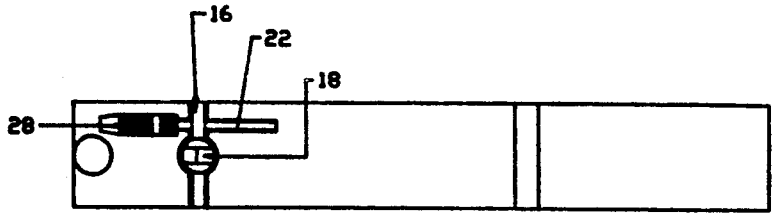
FIG. 1 shows a top plain view of the rear portion of the handgun.
Figure 4:
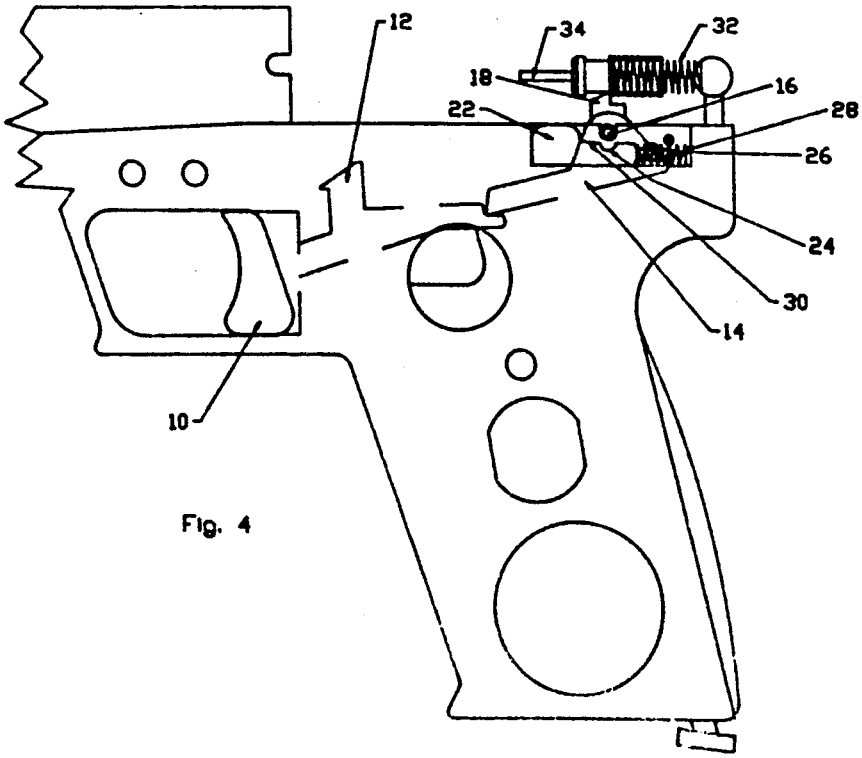
FIG. 4 is the view from the opposite side of the handgun as to FIG. 2.

FIG. 1 which is a top view of the handgun shows a plate 22 in position on the left side of the sear pin 18. The plate 24 can be placed on either side of the sear pin 18 as long as the sear pin 18 has the cylindrical rod 16 attached to it upon that side. FIGS. 2 and 4 shows the positioning of the invention from either side of the gun.

The plate 22 in the preferred embodiment is made out of metal; however, it can be made out of any substance that is sufficiently hard that the ridge 30 will not be damage by the falling of the sear pin's cylindrical rod 16. This plate 22 in the preferred embodiment is flat and is stamped out of metal to make it inexpensive and rugged. However the plate could be cylindrical or any other shape. The only dictate as to the shape is that it is of sufficient dimension and shape so that when the plate 24 falls under the sear pin 18, the plate 24 will keep the sear pin 18 from falling and releasing the firing pin. There is no necessity for the plate to have a notch. The plate could be position in front of the sear pin under normal firing condition and when dropped and upon impact of the rear of the firearm with the ground the plates inertia would carry it under the sear pin and keep it from dropping the sufficient distance to release the firing pin. The spring 28 in the preferred embodiment is also made out of metal. However, any substance can be used as long as the plate 24 has sufficient interia to over come the compressive force of the spring 26 so that the plate 24 will move quickly enough so that the ridge 30 will move under the sear pin's cylindrical rod 16 before the sear pin 18 drops.

The preferred embodiment described above is for a handgun. However, the invention could be used in any hammerless firearm including rifles and shotguns.

Changes in modification and these specifically described embodiments can be carried out without departing from the scope of the invention which is intended to be limited only by the scope of the appended claims.

It is claimed:

1. A firing mechanism for a firing arm with a rear end comprising:

a. a sear pin; and, b. a first spring that is held in a compressed state by the sear pin and is released from the compressed state when the sear pin moves downward; and, c. a firing pin which is in contact with the first spring and when the first spring is released the firing pin is propelled forwardly by the first spring firing the firing arm; and, d. a trigger assembly; and, e. a means for attaching the trigger assembly to the sear pin such that when the trigger is pulled the sear pin moves downward; and, f. a means for keeping the sear pin from falling downward and from releasing the first spring when the fire arm is dropped and the firearm's rear end makes impact with a surface.

2. A firing mechanism for a fire arm with a rear end as in claim 1 wherein:

a. The means for keeping the sear pin from falling downward is a plate that falls under the sear pin when the fire arm is dropped and the rear end of the fire arm makes contact with the ground and said plate keeps the sear pin from moving downwardly a sufficient distance to release the first spring.

3. A firing mechanism for a firing arm with a rear end as in claim 1 wherein:

a. The sear pin has a cylindrical bar attached to it; and, b. The means for preventing the sear pin from falling downward when the fire arm's rear end makes an impact with the ground is a plate that fits under the sear pin, and said plate has a notch, which under normal firing conditions fits underneath the cylindrical bar attached to the sear pin and under normal firing conditions the sear pin falls into the notch thus falls a sufficient distance to release the spring and when the fire arm is dropped and the fire arm's rear end makes impact with the ground the plate with the notch moves so that the sear pin can no longer fall within the notch and has to fall upon a ridge of the plate and can not fall a sufficient distance to release the first spring.

4. A firing mechanism for a firing arm as in claim 3 further comprising:

a. a second spring which holds the plate in place and when the fire arm is dropped and said fire arm rear end makes impact with the ground, the spring is adapted such that the interia of the plate will compress the spring and allow the plate to fall fast enough so that the sear pin will not fall within the notch of the plate but fall upon the ridge of the plate and therefore not fall a sufficient distance to release the first spring.

* * * * *